United States Patent [19]

Chambers et al.

[11] 3,999,934

[45] Dec. 28, 1976

[54] START UP CIRCUIT

[75] Inventors: William W. Chambers, Anaheim; James N. Brooks, Hermosa Beach, both of Calif.

[73] Assignee: Robertshaw Controls Company, Richmond, Va.

[22] Filed: May 23, 1975

[21] Appl. No.: 580,427

[52] U.S. Cl. ..... 431/63; 236/1 E

[51] Int. Cl.[2] ..... F23N 5/00

[58] Field of Search ..... 431/63, 62; 236/1 A, 236/1 E, 78 D; 219/497, 499, 501

[56] References Cited

UNITED STATES PATENTS 3,818,247 6/1974 Chambers et al. ..... 219/501

*Primary Examiner*—Alan Cohan

*Attorney, Agent, or Firm*—Fulwider, Patton, Rieber, Lee & Utecht

[57] ABSTRACT

In a thermostat control system including means for modulating the fuel flow to a burner above a predetermined level necessary for combustion, the improvement comprising an ignition circuit adapted to provide a larger fuel flow initially to the burner including in one embodiment a bimetallic switch connected for thermal communication with the burner cavity for completing the circuit of the above thermostat control system after the burner cavity reaches a predetermined temperature.

In a second embodiment, a time delay circuit is provided instead of the bimetallic switch, such time delay circuit providing a larger fuel flow to the burner during the ignition time interval.

9 Claims, 6 Drawing Figures

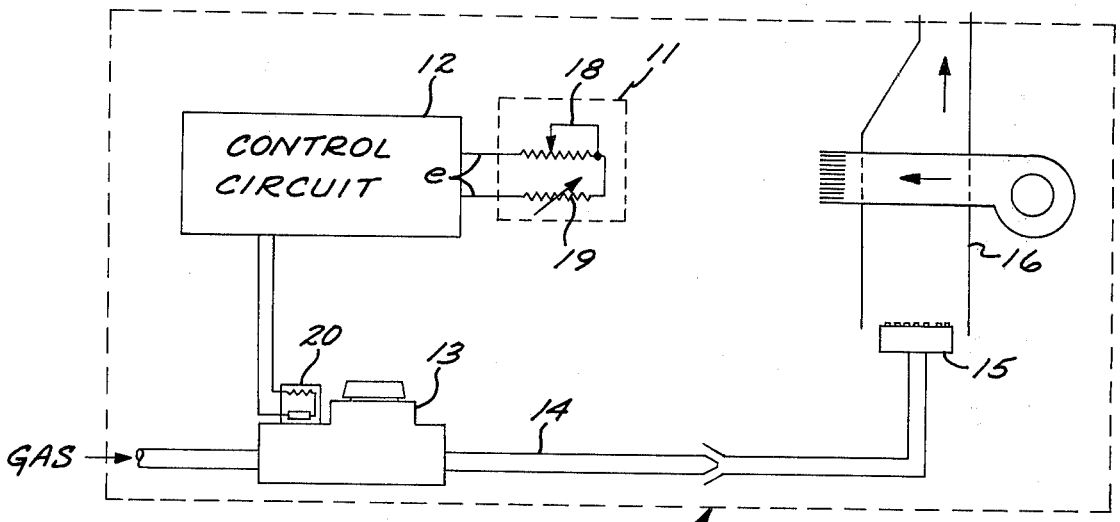
FIG. 1 10
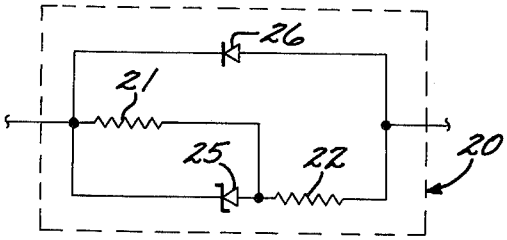
FIG. 2
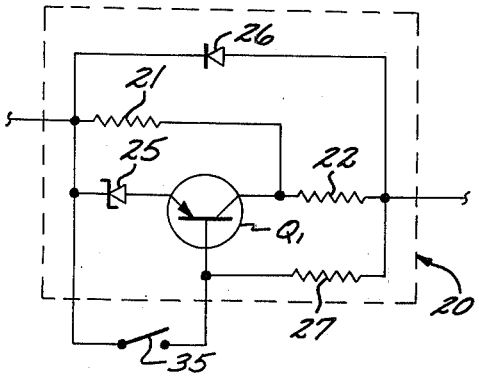
FIG. 4
FIG. 3
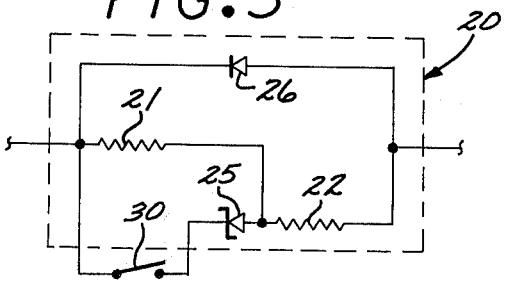
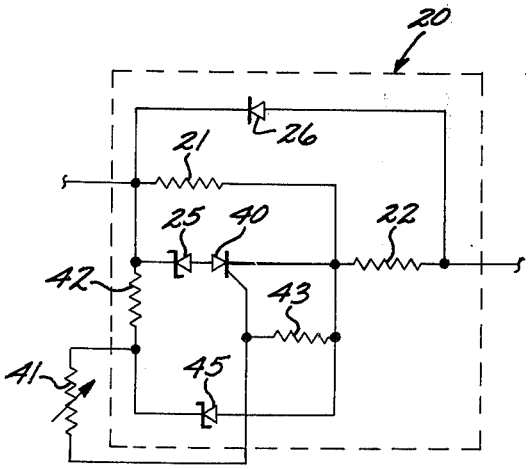
FIG. 5
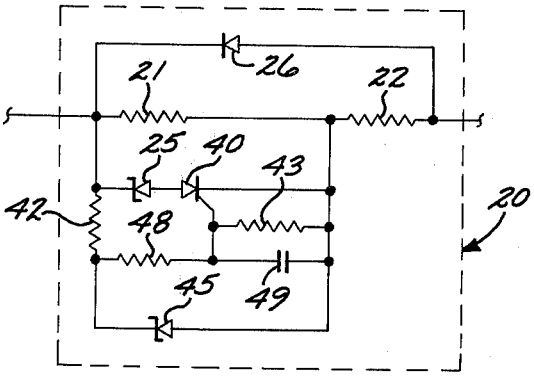
FIG. 6

START UP CIRCUIT

BACKGROUND OF THE INVENTION

1. Field of the Invention

While the invention is of general utility, it is particularly suitable for use with, and will be described in connection with, the apparatus of the type shown and described in copending patent application U.S. Ser. No. 240,700 for Two-Lead Electrical Control Apparatus, assigned to the same assignee, and now allowed.

The present invention relates to thermostat controlled heating systems, and more particularly to electrical circuits which allow for a larger fuel flow rate during ignition in comparison with the rate necessary to maintain the burn.

2. Description of the Prior Art

In gas fueled home heating installations and similar facilities a typical problem is that the gas-air mixture necessary to achieve ignition of the burner chamber or cavity is well defined and steps must be taken to assure repeatability in attaining a mixture near the ignitor which will ignite. In view of the transient fuel flow nature, local variations occur which at low velocities of fuel flow in the burner cavity may be locally insufficient for ignition. Because of the small size of a typical ignitor it is desirable to have maximum ignitable mix in the chamber to insure contact between the mix and the ignitor. Most prior art systems did not discriminate between the ignition or start up state and the burn state, particularly since the burn state typically also calls for some fairly high fixed level of fuel supply to provide enough heating. Both the ignition and burn requirement has all of the characteristics of a contactor system, i.e., an on-off system which is very often incompatible with precise control over temperature.

In phase commutated prior art systems, such as the one described in U.S. Pat. No. 3,818,247, gain linearity is achieved by truncating the height of the commutated signal to a fuel control valve. Such has been done in the above-referenced patent by a Zener diode connected across the control valve, such Zener diode effectively converting phase commutation to pulse width modulated type of control. In this manner, signal levels above Zener breakdown were left unutilized.

Once the system is ignited, however, the criteria for maintaining combustion are much less stringent and such lower signal levels and consequently lower fuel flow rates can be applied in order to sustain combustion.

SUMMARY OF THE INVENTION

Accordingly, it is the general purpose and object of the present invention to provide a simple and convenient start up circuit adapted for use with typical thermostatically controlled fuel control valves which will allow a larger initial response gain in the fuel rate, maintained for an interval of time sufficient to assure ignition, at the conclusion of which the control system reverts to the lower gain levels necessary to sustain burning. Other objects of the invention are to provide a start up circuit which responds to the temperature of the plenum in order to provide higher flow rates into the burner cavity until the plenum chamber or the burner cavity reaches some predetermined temperature. Yet further objects of the present invention are to provide a start up circuit which comprises few parts, is reliable and is therefore easy to maintain.

According to one embodiment, these and other objects are accomplished within the present invention by modifying a Zener clipped phase commutated thermostat control system to include a temperature responsive bimetallic switch in circuit with the clipping Zener diode. Accordingly, when the switch is open the Zener diode is removed from the circuit and the full amplitude of the phase commutated signal is passed to the control valve regulating fuel flow. The bimetallic switch is thermally coupled with the burner cavity or the plenum chamber of the heater unit and is initially open.

Generally, while particular reference is made to the teachings of the recited application, the heating control system can be described in conventional terms of a servo loop. Such system includes the external loop comprising the building to be heated, the heating plant and the control system regulating the heating plant, where loop closure is made at the thermostat. Accordingly, the thermostat acts as the summing node of a closed loop system, combining the sensed temperature with the desired temperature to produce an error signal. This error signal is then passed to the control system or the heating plant regulating system, which, in prior art, often took the form of a contactor system. Contactor systems possess some undesirable features and have been therefore modified in the past to include the characteristics of a linear system. One such system is that described in the cited application. In this system, the control or regulation of the fuel flow to the heating plant is made by way of phase commutation of an A.C. signal to a fuel control valve according to the error signal from the thermostat. Since more control authority can be achieved by a linear system for the same loop gain, the nonlinear characteristics of phase commutation were taken out by a Zener diode which in effect changed the control system to a pulse width modulated system. This Zener diode has been connected with the switch of this invention in order to effect higher gain and therefore higher fuel flow at ignition.

The series circuit of the Zener diode and the bimetallic switch is connected across the control valve shown as a resistor, which in combination with a second resistor in series with the Zener diode sets the signal gains to the control valve in the heating plant in order to open the control valve to a larger level of gas flow rate during ignition. After the plenum chamber reaches the temperature at which the bimetallic switch effects a closure the Zener diode is brought back into the circuit, shorting the valve heat motor for all signals levels above the Zener breakdown. Since the Zener diode will pass signals only if the voltage thereacross exceeds the Zener breakdown, linear control can be effected at all voltage levels above the Zener breakdown.

In a second embodiment, the Zener diode is connected in the emitter circuit of a transistor with the bimetallic switch connected in the base biasing circuit thereof, such configuration allowing for a normally closed configuration of the bimetallic switch.

In yet a further embodiment, the bimetallic switch is replaced either by a thermistor which connects the Zener diode through the voltage differential impressed on the gate of an SCR, thus effecting a switch closure upon plenum chamber warm up, or by an RC circuit which completes the connection with the Zener diode after a predetermined time delay.

BRIEF DESCRIPTION OF THE DRAWINGS

FIG. 1 is a block diagram of a thermostat controlled system including the inventive start up circuit in the signal path thereof;

FIG. 2 is a Zener diode controlled circuit as practiced in the prior art;

FIG. 3 is a Zener diode step circuit shown in FIG. 2 connected in series with a bimetallic switch taught by the present invention;

FIG. 4 is yet another embodiment of the circuit shown in FIG. 3;

FIG. 5 is a further embodiment of the circuit shown in FIG. 3 wherein the bimetallic switch is replaced by a thermistor; and FIG. 6 is yet one more embodiment of the circuit shown in FIG. 3 including an RC circuit connected across the gate of an SCR in order to provide a selective time delay in the operation of the inventive circuit.

DESCRIPTION OF THE SPECIFIC EMBODIMENTS

The present invention is described by way of a phase commutated fuel control circuit wherein a Zener diode is used to clip the phase commutated signal to effect pulse width modulation. While alternative means can be implemented, all of which can perform the same function and all of which are compatible with the present invention, the inventive start up circuit is shown in combination with a heater control circuit described in the above-mentioned U.S. Pat. No. 3,818,247 entitled Two-Lead Electrical Control Apparatus and assigned to the same assignee. In the above-referenced patent, a Zener diode is used to limit the amplitude of the commutated signal to a valve regulating fuel flow.

As shown in FIG. 1, a temperature control system of the kind described above is generally indicated by the numeral 10. A resistive thermostat 11 including an adjustable potentiometer 18 and a thermistor 19 provides an error signal *e* to a control circuit 12, which sets the commutation interval of a signal *c* controlling the opening of a line valve 13. The line valve 13 in turn controls the fuel flow rate in a gas line 14 to a gas burner 15. Thus each time an error signal *e* indicates an under-temperature condition, a proportional amount of valve opening is made. Since typically in phase commutation for very small values of error signal *e* very small amplitudes of the A.C. signal are commutated while at larger levels of signal *e* the A.C. signal is commutated close to the peak, a clipping circuit 20 is incorporated which allows for a fixed maximum signal across the valve 13.

In the prior art the clipping circuit 20 has been constructed, at least in the example referred to hereinabove, according to the configuration shown in FIG. 2. More specifically, the configuration shown in FIG. 2 includes a circuit comprising two series connected resistors 21 and 22 wherein resistor 21 is the motor which operates the valve 13 and is shunted by a Zener diode 25 connected at the anode to the common junction between resistors 21 and 22 and at the cathode to the distal end of resistor 21. The series circuit comprising resistors 21 and 22 and is also shunted by a diode 26. Diode 26 provides for commutation of the alternate half wave to signal *c* which operates valve 13, while diode 25 provides a fixed voltage formed by the reverse breakdown thereof, in parallel across valve motor resistor 21. Accordingly, for voltage levels across resistor 21 or the valve 13 which are below the Zener breakdown of diode 25 the signal across resistor 21 follows the commutation of the A.C. signal at increments corresponding to signal *e*. For voltage increments across resistor 21 above the Zener breakdown of diode 25, a low resistance by-pass is formed across resistor 21. In this manner, diode 25 provides a limit or maximum level of the signal to valve 13 which operates a pulse width modulated control device.

As shown in FIG. 3, a bimetallic switch 30 is shown in series with diode 25. The bimetallic switch 30 is disposed in thermal communication with the plenum chamber 16 around the burner 15, switch 30 being in this instance formed in a manner of a normally open switch which upon reaching a predetermined temperature level will close to connect diode 25 across resistor 21. Once diode 25 is thus connected into the circuit, resistor 21 sees effectively only pulse width modulated signals and the operation described above is resumed. Prior to the closure of switch 30, however, the full amplitude of the commutated A.C. signal appears across the resistor to drive valve 13. Accordingly, a larger valve response for a given error signal *e* will be developed while ignition is taking place. Once a burn is sustained for a sufficient length of time to close switch 30, the control system then drops down to the voltage limits of diode 25 and will continue to operate at that level as a pulse modulated system until an error signal of less than the Zener breakdown voltage is applied across diode 25. Since reference is made to an A.C. system, again, a shunt connection is shown by way of diode 26 to provide for commutation of the alternate half wave to the signal to the valve 13.

In FIG. 4, a further improvement is made to the circuit shown in FIG. 3 by connecting the anode of diode 25 to the emitter of a transistor Q1. The diode is opposed to the emitter-base bias of transistor Q1 and Q1 will therefore act to control the Zener current flow through the Zener. The base circuit of transistor Q1 includes a bimetallic switch 35, which in this instance is a normally closed switch, connected between the cathode of diode 25 and the base of transistor Q1. In this circuit diode 25 and the emitter collector path of transistor Q1 form a short across the resistor 21 again to complete the circuit to resistor 22. Such is only possible if switch 35 is open. Accordingly, diode 25 will not respond to any current or voltage levels until switch 35 opens, thus establishing the base signal to transistor Q1 and therefore rendering the transistor conductive. The configuration shown in FIG. 4 similarly includes diode 26 for full wave commutation and a base-collector resistor 27 necessary for base bias.

A further embodiment of the inventive circuit is shown in FIG. 5. In this instance, all solid state elements are used in a circuit to perform the function of the bimetallic switches 30 or 35. More specifically, the circuit of FIG. 5 again includes the two series connected resistors 21 and 22 and the diode 26, all of which are performing the same functions described above. In addition, the Zener diode 25 is shown connected in opposing bias across the anode to cathode path of a silicon controlled rectifier (SCR) 40, diode 25 and the SCR 40 forming the shunt circuit across resistor 21. The gate terminal of the SCR 40 is pulled off from the common junction of a voltage divider circuit comprising a negative temperature coefficient resistor 41 which connects at the free ends across a current limiting resistor 42 to the cathode of diode 25. The other side of the divider is formed by a gate resistor 43 joining the common junction between resistors 21 and 22. The voltage divider circuit further includes yet another Zener diode 45 across resistors 41 and 43 which stabilizes the voltage for division and which is current limited by resistor 42. It is to be noted that diode 45 necessarily must operate at voltage breakdown levels significantly lower than diode 25. This circuit, therefore, acts to stabilize the line voltage fluctuations across the voltage divider in order to set a predictable and a repeatable voltage level at which SCR 40 becomes conductive. When SCR 40 is conductive, diode 25 will conduct to regulate out any excess voltage appearing across resistor 21 to operate the valve 13 in the manner of pulse modulation.

By way of the example shown in FIG. 6, it is possible to form a start transient circuit which is not thermally coupled to the temperature of the plenum chamber or the burner cavity. More specifically, the circuit of FIG. 6 comprises essentially the same circuit elements of FIG. 5, including diode 45, the gate resistor 43 and the current limiting resistor 42, but replacing the negative temperature coefficient resistor 41 by a fixed resistor 48 in series with a capacitor 49 across resistor 43. The capacitor 49, resistor 43 and resistor 48 combination provides an RC network of a predetermined time constant which will gate the SCR 40 into conduction upon the expiration of a fixed time delay. The time delay can be conveniently controlled by the relative sizes of resistors 48 and 43 and the size of the capacitor 49. In this instance, no direct measurements of the cavity or the plenum chamber temperature is necessary, it being presumed that after a time delay of known duration a steady state burn is established within the burner cavity.

The inventive embodiments of the start up transient circuit shown in FIGS. 3, 4, 5 and 6 operate in an essentially identical manner. The circuits shown in FIGS. 3, 4 and 5 include thermally responsive elements, i.e., the normally open switch 30 in FIG. 3, the normally closed switch 35 in FIG. 4 and the negative temperature coefficient resistor 41 in FIG. 5. The essential operation of these above referenced elements is substantially similar, in each case closing a path across resistor 21 and therefore imposing the Zener voltage thereof as the signal limit across resistor 21. The conduction is only effective if the plenum chamber reaches the required temperature to either close switch 30, open switch 35 or to drive the resistance level of resistor 41 below the gating level of SCR 40. On the other hand, the circuit shown in FIG. 6 makes no direct connection to the thermal environment of the plenum chamber and relies on previously determined time constants necessary to effect a steady state burn within the burner cavity. This time constant is simply accomplished by an RC network on the gate of the SCR 40 which then again completes the path across diode 25 in shunt with resistor 21. Again, in this instance the shunt effect of diode 25 imposes a fixed voltage limit across resistor 21 to linearize and lower the response gain of valve 13. Switches 30 and 35 or the SCR 40 in combination with either the resistor 41 or the RC network shown in FIG. 6 form the ignition transient circuit which allows for large but nonlinear valve gain levels during start up. In this manner, control of a heater facility is provided which both accommodates the start up requirements of a burner and which furthermore provides linear control over the fuel flow rate to the burner after start up.

Some of the many advantages of the present invention should now be readily apparent. By way of simple circuit elements, the present invention accomplishes distinct functional steps in any control scheme required for gas fired burners. The required elements are both simple and reliable, while being furthermore configured in highly reliable circuits, all such being done without effecting either the accuracy or the gain of the overall system.

Obviously, many modifications and variations of the present invention may be made with regard to the foregoing detailed description without departing from the spirit of the invention.

What is claimed is:

1. In a heating facility including a burner, sensing means disposed to register the temperature of the enclosure to be heated, input means connected to said sensing means for selective adjustment of a desired temperature, said sensing and input means combining to produce an error signal, and control means connected to control the heat produced by the burner in a first response gain proportional to said error signal when said error signal is above a first increment of amplitude and a second response gain when said error signal is below said first increment of amplitude, the improvement comprising:

ignition means operatively responsive to the temperature of the burner for converting the response of said control means to said second response gain for all values of said error signal when said burner is below a predetermined temperature.

2. Apparatus according to claim 1, further comprising:

said error signal is an electrical signal proportional in amplitude to the difference between said input means and said sensing means; and said control means includes a control valve having a first resistor, said first resistor being connected in series with a second resistor receiving said error signal, a Zener diode connected across said first resistor, and a temperature responsive switch connected in circuit with said Zener diode and exposed for thermal response to the structure of said burner.

3. Apparatus according to claim 2 wherein:

said temperature responsive switch is a normally open bimetallic switch.

4. Apparatus according to claim 1 further comprising:

said error signal includes an electrical signal proportional in amplitude to the difference between said input means and said sensing means;

said control means further including a control valve having a first resistor, said first resistor being connected in series with a second resistor in circuit with said error signal, a Zener diode connected across said first resistor, a transistor connected in the emitter circuit to said Zener diode, and a thermally responsive switch connected to the base of said transistor and exposed to communicate with the temperature of said burner.

5. Apparatus according to claim 4 wherein:

said temperature responsive switch is a normally closed bimetallic switch.

6. Apparatus according to claim 1 further comprising:

said error signal includes an electrical signal proportional in amplitude to the difference between said input means and said sensing means;

said control means further including a control valve having a first resistor, said first resistor being connected in series with a second resistor in circuit with said error signal, a Zener diode connected across said first resistor, a semiconductor device connected in circuit with said Zener diode and thermally responsive gating means connected to render said semiconductor device conductive when said burner is above a predetermined temperature.

7. Apparatus according to claim 6 wherein:

said semiconductor device is a silicon controlled rectifier; and said thermally responsive gating means includes a thermistor.

8. In a heating facility including a burner, sensing means disposed to register the temperature of the enclosure to be heated, input means connected to said sensing means for selective adjustment of a desired temperature, said sensing and input means combining to produce an error signal, and control means connected to control the heat produced by the burner in a first response gain proportional to said error signal when said error signal is above a first increment of amplitude and a second response gain corresponding to the increment of amplitude of said error signal below said first amplitude, the improvement comprising:

ignition means operatively responsive to said error signal for maintaining the control means in said second response for a predetermined time interval at all error signal amplitudes.

9. Apparatus according to claim 1 further comprising:

said error signal includes an electrical signal proportional in amplitude to the difference between said input means and said sensing means;

control means further including a control valve having a first resistor connected in series with a second resistor and in circuit with said error signal, a Zener diode connected across said first resistor, semiconductor means connected in circuit with said Zener diode and time constant means for rendering said semiconductor means conductive within a predetermined time increment.

* * * * *